US006289609B1

(12) United States Patent
Bowen

(10) Patent No.: US 6,289,609 B1
(45) **Date of Patent: *Sep. 18, 2001**

(54) LACE SUBSTITUTE SHOE FASTENING MECHANISM

(76) Inventor: Richard Bowen, 331 Varick St., Jersey City, NJ (US) 07302

( * ) Notice: Subject to any disclaimer, the term of this patent is extended or adjusted under 35 U.S.C. 154(b) by 0 days.

This patent is subject to a terminal disclaimer.

(21) Appl. No.: 09/382,317

(22) Filed: Oct. 19, 1999

Related U.S. Application Data

(63) Continuation-in-part of application No. 09/126,478, filed on Jul. 30, 1998, now Pat. No. 6,018,890.

(51) Int. Cl.[7] ..... A43C 11/00; A44B 21/00
(52) U.S. Cl. ..... 36/50.1; 292/300; 24/685 K
(58) Field of Search ..... 36/50.1, 50.5; 24/685 K, 695 K, 705 K, 715 K, 683, 684, 686, 682.1; 292/101, 202, 300, 307, 311, 163 R; 206/1.5

(56) References Cited

U.S. PATENT DOCUMENTS 4,470,175 * 9/1984 Chiarella ..... 36/50.5
4,575,958 * 3/1986 Arieh et al. ..... 36/50.5
5,365,679 * 11/1994 Chemello ..... 36/50.5
5,383,258 * 1/1995 Nicoletti ..... 24/68 SK
5,501,023 * 3/1996 Miotto ..... 36/50.5
5,669,122 * 9/1997 Benoit ..... 24/71 SK
5,819,378 * 10/1998 Doyle ..... 24/71 SK
6,018,890 * 2/2000 Bowen ..... 36/50.1
6,049,955 * 4/2000 Bowen ..... 24/68 SK

* cited by examiner

*Primary Examiner*—M. D. Patterson

(57) ABSTRACT

A continuation in part of U.S. Pat. No. 6,018,890 the fastener device portion of the patent. Another version of the fastening device comprises an actuating lever rotatably secured to one flap of a shoe and where hinged onto actuating lever is a tie element extending substantially in alignment therewith, and comprising a substantially planar undersurface with a series of hook element projecting therefrom where any of the hook elements are engageable with a catch element secured to the opposing flap of shoe. Another version of the device has a tie element comprising a substantially planar and rectangular component defining a series of rung like members where each rung like member is engageable to said catch element. Like the first embodiment described in U.S. Pat. No. 6,018,890 upon rotation of the actuating lever towards the opposing flap the tie element translates laterally towards and beyond catch element, and upon rotating of actuating lever away from opposing flap the tie element translates laterally away from catch element causing engagement between the catch element and any of the said hook elements or between catch element and any of the said rung like members. Ramifications of the device include multiple axle support heating assemblages, bearing assemblages, repositionable on bearing mount via detachable and interfitting engagement of recesses and protrusion located on an undersurface of bearing assemblage with corresponding recesses and protrusions located on bearing mount, and hearing assemblages and catch element secured to their respective mounts via swivel means.

19 Claims, 7 Drawing Sheets

FIG. 4A
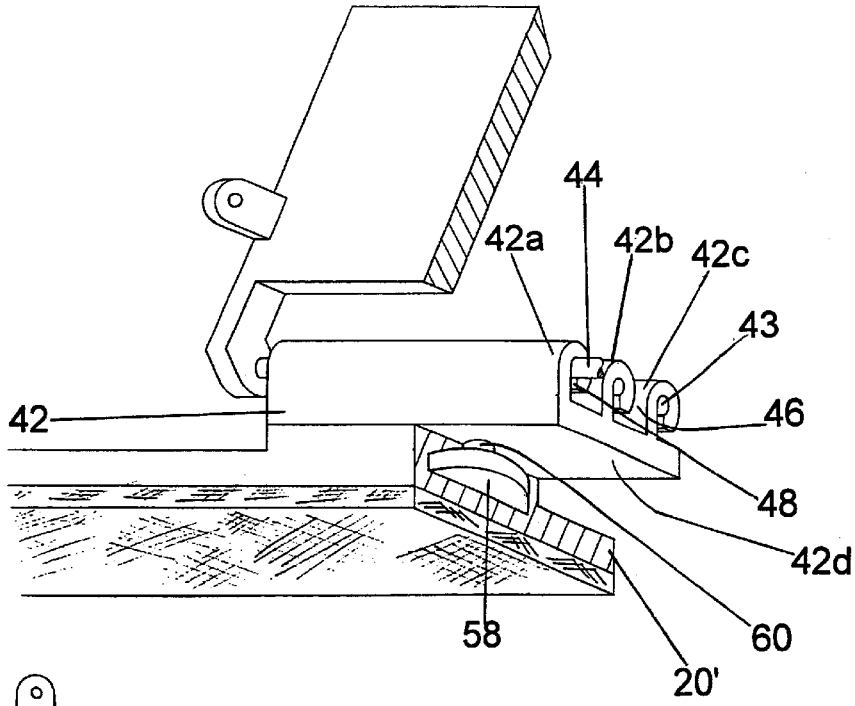
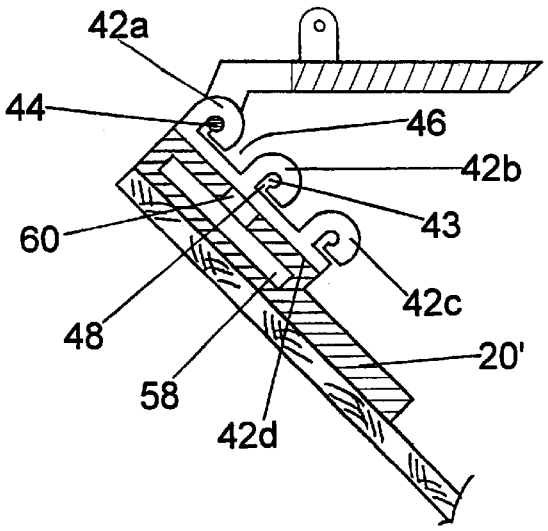
FIG. 4B
FIG. 4C
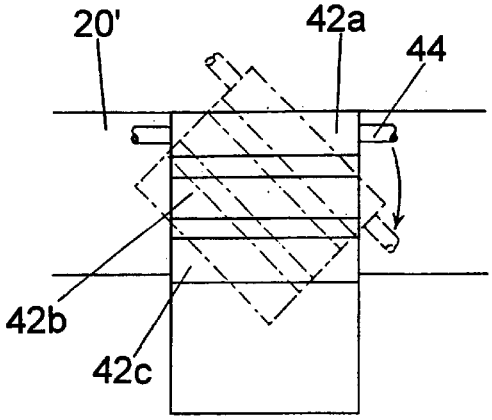

FIG. 5A
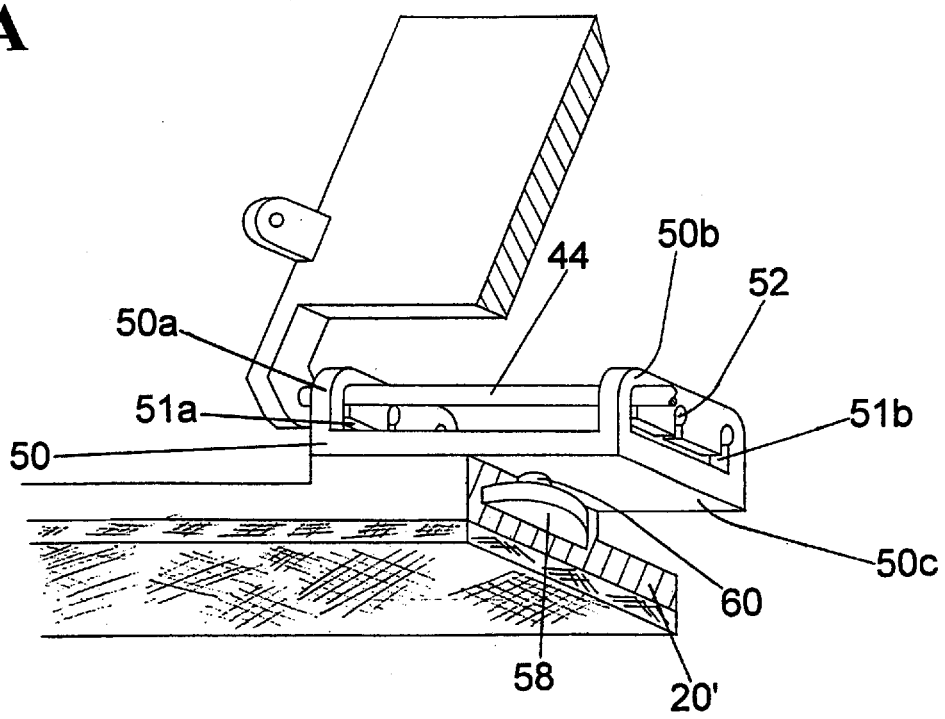
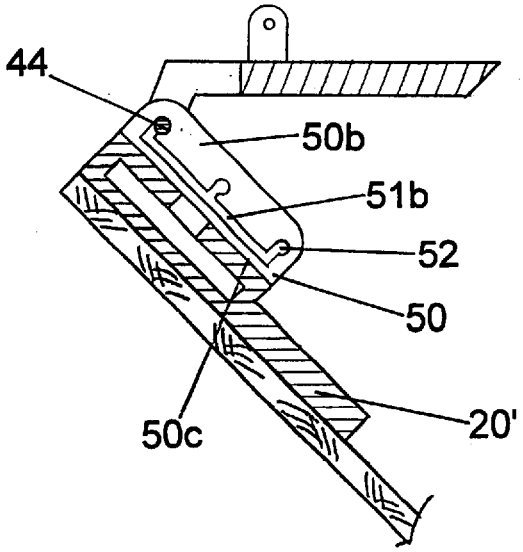
FIG. 5B
FIG. 5C
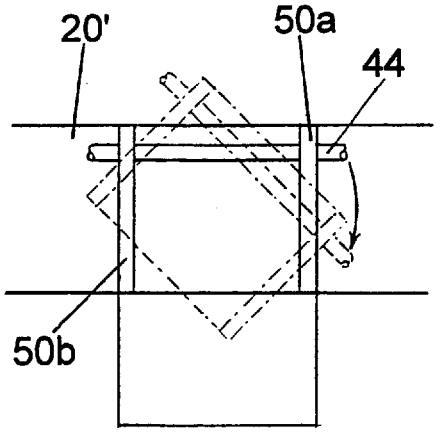

FIG. 6A
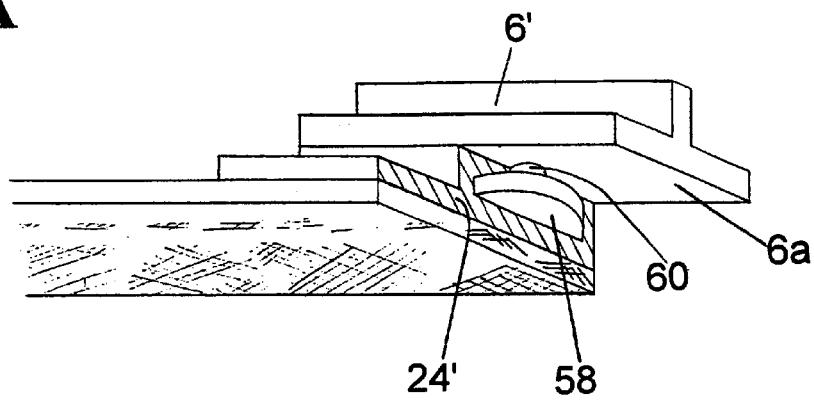
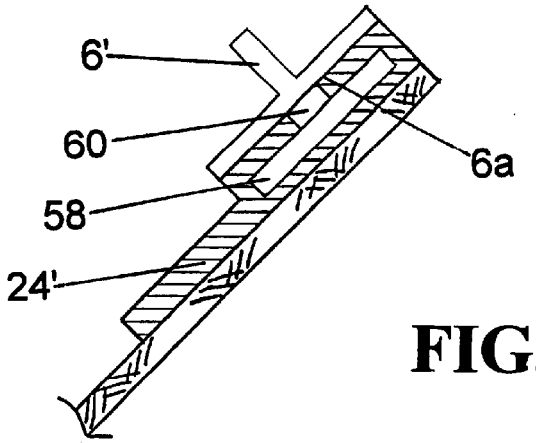
FIG. 6B
FIG. 6C
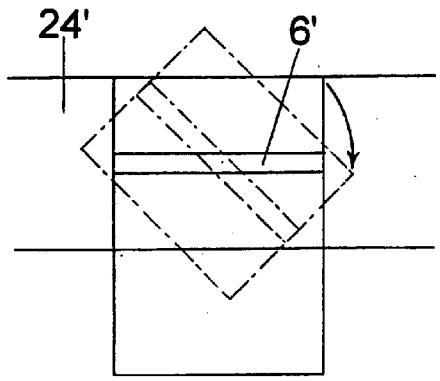

LACE SUBSTITUTE SHOE FASTENING MECHANISM

This is a Continuation In Part of Ser. No. 09/126,478 filed Jul. 30, 1998 now U.S. Pat. No. 6,018,890.

SUMMARY

A continuation in part of U.S. Pat. No. 6,018,890 provides a shoe fastening device employing use of a hand actuated lever which is attached to one flap of a shoe, a tie element pivotally attached to said lever and which acts as an extension of lever, and where one tie element is exactly described in abovementioned patent. Another having a series of hook elements projecting from an undersurface, and another version having a series of rung like members, and where either a hook element or a rung like member engages a catch element secured to the opposing flap of shoe, and with ramifications to the device including multi axle support bearing assemblages, bearing assemblages repositionable on bearing mount, and bearing assemblages and catch element swivel capable.

BACKGROUND

1. Field of Invention

This invention is related to the field of shoe securing and fastening devices, and pertains more particularly to a lace substitute for conventional shoes constructed with duel flaps on opposing sides of a tongue.

2. Discussion of Prior Art

Many shoe lacing systems have been designed to provide a faster and more convenient way of securing a shoe onto the foot. The vast majority of these systems are "lace closure systems" which accomplish this task in part by means of a lace or pliable fibre through which tension is applied. Some examples not withstanding are U.S. Pat. Nos. 5,353,483; 5,469,640; and 5,471,769. Problems inherent in lace closure systems includes unwanted tightening of knots caused by tension in laces occurring through everyday use of shoe, and weakening and eventual breakage of lace at points where lace rubs against eyelets of shoe. Lace closure systems may also be impractical and undesirable by persons with rheumatoid arthritis, or persons with weight problems, or injuries which make it difficult for them to bend over for the period of time required to perform lace closure. Both U.S. Pat. Nos. 5,148,614 and 5,529,094 are designed to achieve relatively rapid fastening by non lace closure methods, but U.S. Pat. No. 5,148,614 still requires somewhat meticulous finger activity and pressure to adjust the strap and effect secure fastening of flaps. U.S. Pat. No. fastening of a shoe but employs use of many small moving parts which increases the risk of something going wrong rendering the device useless. U.S. Pat. No. 4,999,889 uses a lever but still employs use of a lace as an integral means for the transferring of tension and the consequent directing together of opposing flaps and fastening of shoe. This intermediate process is totally eliminated in the present invention and thus eliminates the problems inherent with lace closure methods as mentioned above.

The present invention attempts to overcome the above described deficiencies by describing a shoe fastening system which effects rapid fastening with contiguous motion, has few moving parts, and which is constructed out a rigid durable material such as plastic molding, composite material, or even metal.

OBJECTS AND ADVANTAGES

It is therefore an object of the present invention to provide a new and improved shoe fastening device which effects rapid fastening of shoe.

Another object of the present invention is to provide a new and improved shoe fastening device that is durable and reliable in construction and in particular more durable than conventional lacing systems.

Yet another object of the present invention is to provide a new and improved shoe fastening device which offers adjustable tensioning in such a way so as to allow user to comfortably fasten show onto foot.

A further object of the invention is to provide a new and improved shoe fastening device that allows fastening using gross motor hand activity.

Still yet another object of the invention is to provide a new and improved shoe fastening device which can be easily and cost effectively manufactured.

These together with other objects of the invention, along with the features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

FIGS. 4A, 4B, 4C comprise views of a bearing assemblage, a bearing mount, and said bearing assemblage attached to said bearing mount, respectively.

FIGS. 5A, 5B, and 5C are respectively, a sectional view of one version of a multi axle support bearing assemblage exposing swivel means of said assemblage; a profile sectional view of above stated bearing assemblage with swivel means of said assemblage also exposed, and a top view of same assemblage showing swivel motion of said assemblage.

FIGS. 6A, 6B, and 6C are respectively, a sectional view of another version of a multi axle support bearing assemblage exposing swivel means of said assemblage; a profile sectional view of above stated bearing assemblage with swivel means of said assemblage also exposed, and a top view of same assemblage showing swivel motion of said assemblage.

DESCRIPTION OF FIRST EMBODIMENT

The first embodiment of the invention is exactly the fstening device portion of U.S. Pat. No. 6,018,890, and operates in the manner described herein.

DESCRIPTION OF SECOND AND THIRD EMBODIMENTS

The second embodiment of the invention as seen in FIG. 7 is similar to the first embodiment in all respects except for the tie element. Reviewing FIG. 7 the tie element 36 of this embodiment comprises a singular and substantially rectangular component defining a substantially planar undersurface from which a series hook elements 36' project. Each of the hook elements is engageable with the catch element 6.

Figure 2:
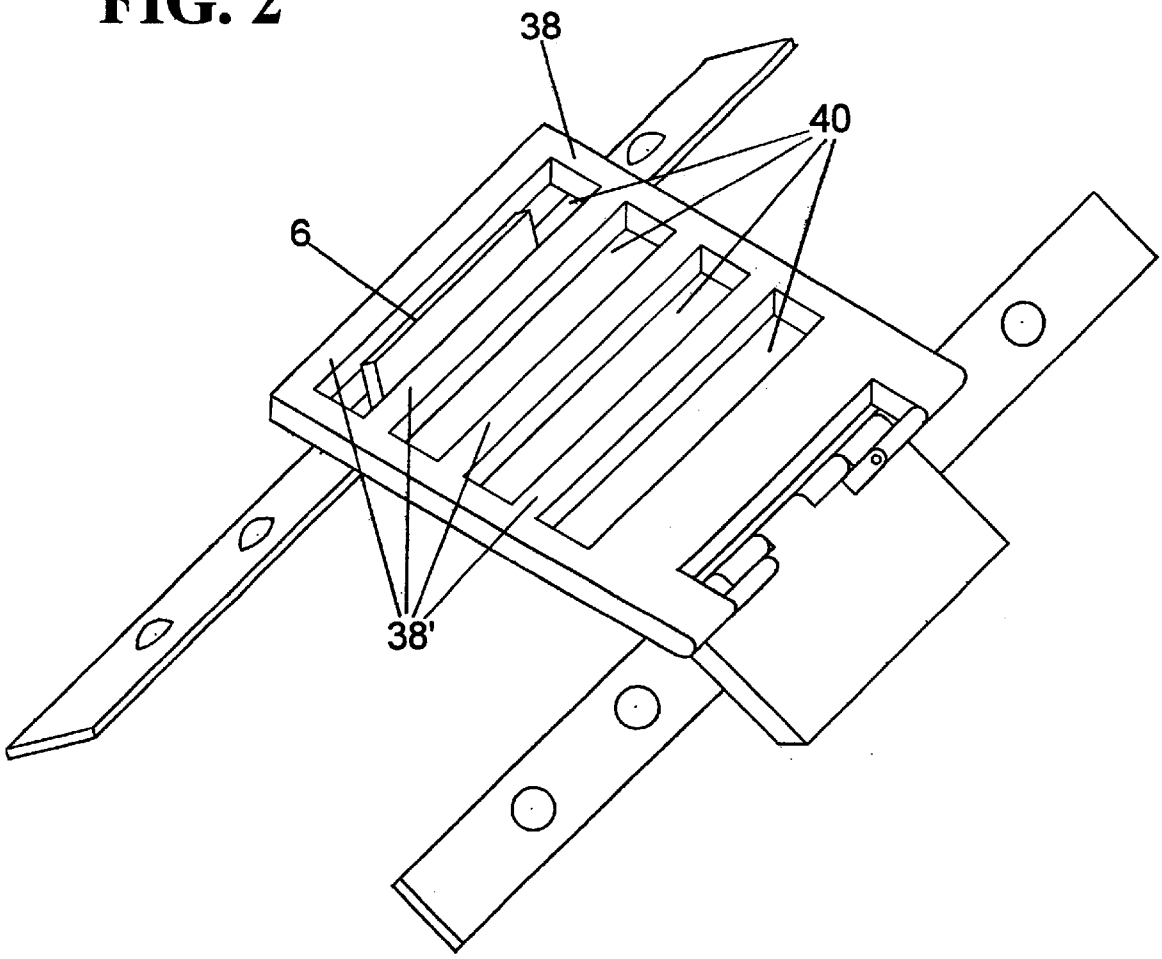
FIG. 2 is an isometric view of another version of the device displaying a runged tie element.
Figure 3A:
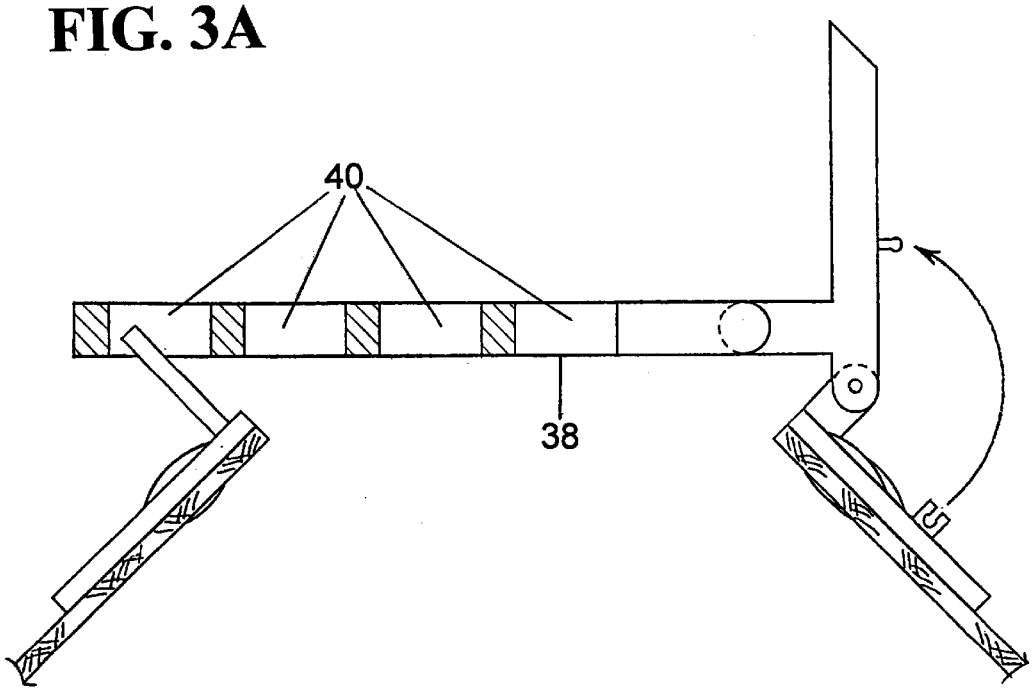
FIGS. 3A and 3B are side views showing operation of the invention of FIG. 2.
Figure 3B:
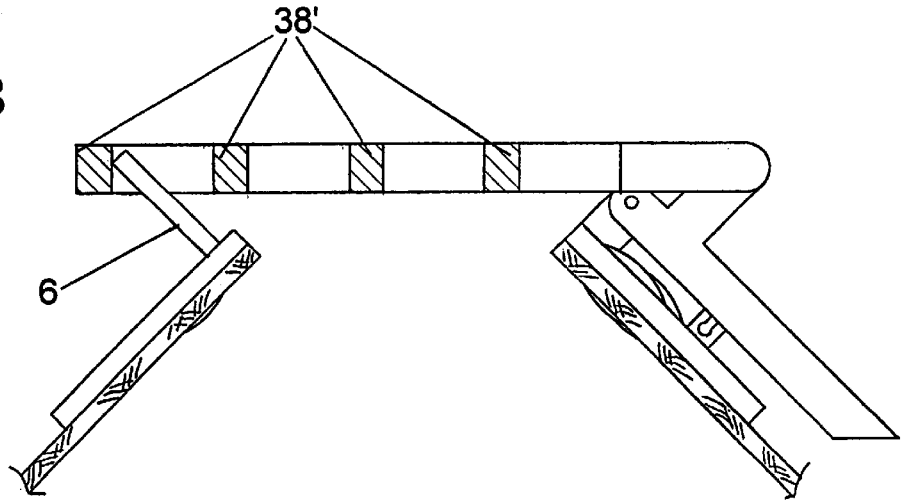

The third embodiment of the invention as seen in FIGS. 2, 3A, and 3B is similar to the first and second embodiments in all respects again except for the tie element. The tie element 38 of this embodiment is a singular and substantially planar component comprising a series of longitudinal surface to surface apertures 40 located through its cross-section and a series of rung like elements 38' where each rung like element is followed by an aperture and each aperture is followed by a rung like element and so on in an alternating fashion. Each rung like element 38' is engageable with the catch element 6.

DESCRIPTION OF OPERATION OF SECOND AND THIRD EMBODIMENTS

Figure 1:
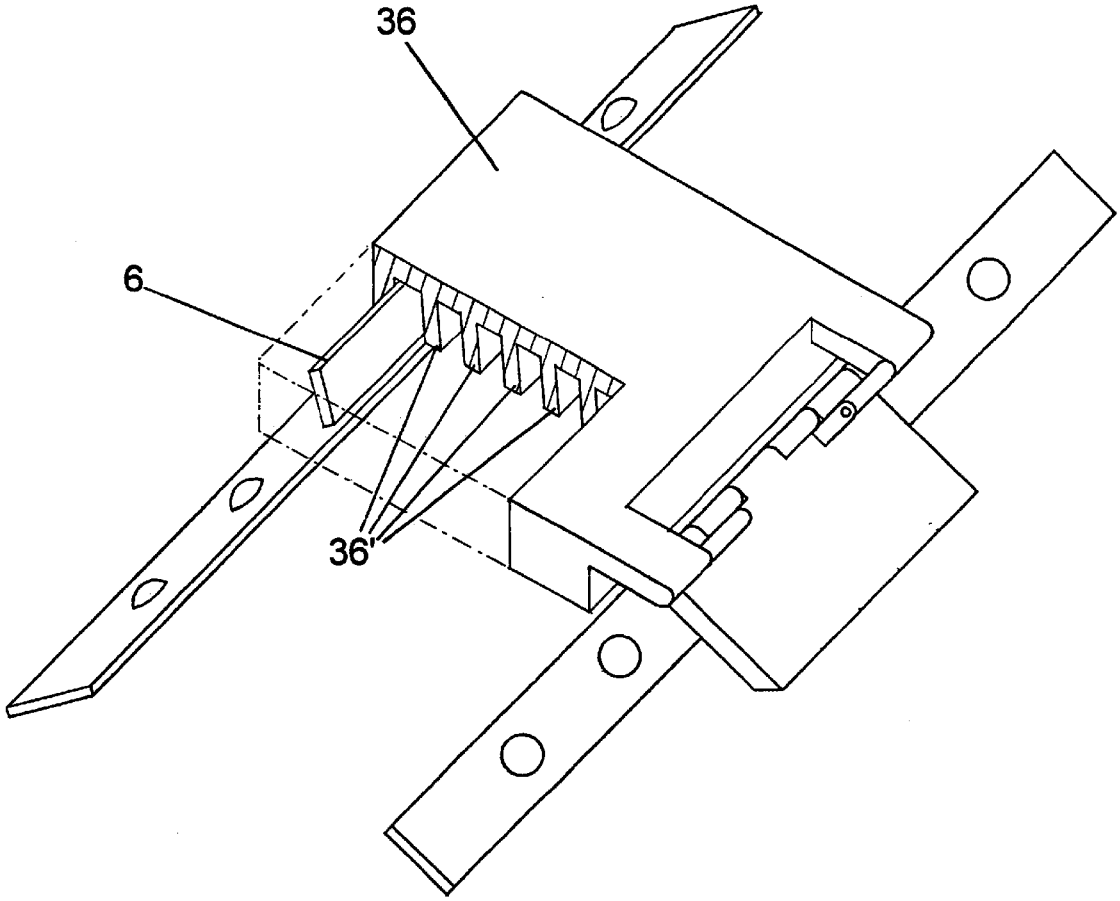
FIG. 1 is an isometric view of a version of the device with a sectional view of the tie element, displaying a series of hook elements.

The second and third embodiments of the invention each operate in a manner similar to that of the first embodiment so that when downward rotatable force is applied to the actuating lever and the tie element retracts, just as interrengagement of the hook element and catch element occurs in the first embodiment in U.S. Pat. No. 6,018,890 there is an interengagement between one of the hook elements 36' and catch element 6 in the case of the second embodiment as seen in FIG. 1 or one of the rung like elements 38' and catch element 6 in the case of the third embodiment and as seen in FIGS. 2, 3A, and 3B.

RAMIFICATIONS OF THE DEVICE

A ramification of the device accommodates variable positioning of the axle about which rotation actuating lever takes place and comes in the form of bearing assemblages defining multiple axle supports for said axle about which the actuating lever rotates. Two versions of this type of bearing assemblage are shown. The first version as seen in FIGS. 4A, 4B, and 4C comprises three axle supports 42*a*, 42*b*, and 42*c* that can be defined as three sections of a pipe all of equal length, each parallel to the other and arranged so that they are equally spaced apart with the ends of any one in alignment with similarly located ends of the others. The inner diameter of the longitudinal openings 43 in pipe sections is wide enough to allow the axle of rotation 44 of actuating lever to just fit in it. The longitudinal spaces 46 between each pipe section and longitudinal slots 48 leading to 43 provides the axle 44 about which the actuating lever rotates with access to the openings 43 in pipe where 44 recesses upon operation of device. The longitudinal slots 48 are not wide enough for axle 44 to naturally fit and as such 44 fits through 48 only when instantaneously passing through. It is assumed that the bearing support and/or the axle about which rotation of the actuating lever takes place is made out of resilient material.

The second version as seen in FIGS. 5A, 5B, and 5C comprise two parallel and laterally spaced apart walls 50*a* and 50*b* each with the similarly located ends of in alignment. Located in each well and symmetrical to each other are slots 51*a* and 51*b* having pulsating or undulating patterns. The slots are not wide enough for the axis 44 about which rotation of the lever takes place to easily fit and are designed to accommodate the axle only when it is passing through them, however located a slots at regular spaced apart intervals are recesses 52 which do more easily accommodate the axle and where opposing portions of said axle 44 recesses and is journalled upon operation of device. The axle however must occupy two similarly located recesses in either slot for proper operation of device.

Figure 7A:
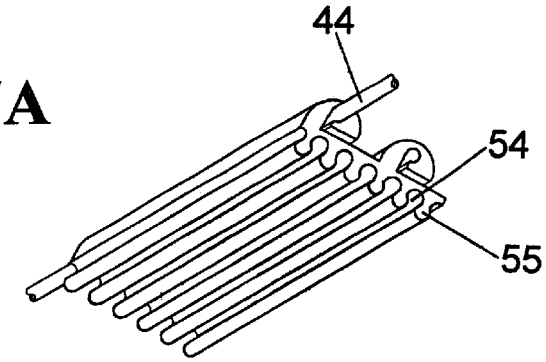
FIGS. 7A, 7B, and 7C are respectively, a sectional view of catch element exposing swivel means of said element; a profile sectional view of above stated catch element with swivel means of said element also exposed, and a top view of catch element showing swivel motion of said element.
Figure 7B:
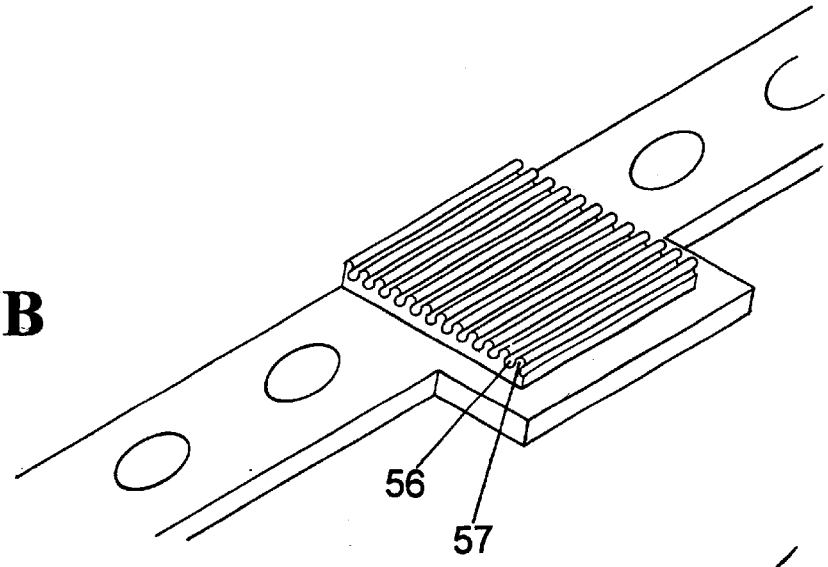
Figure 7C:
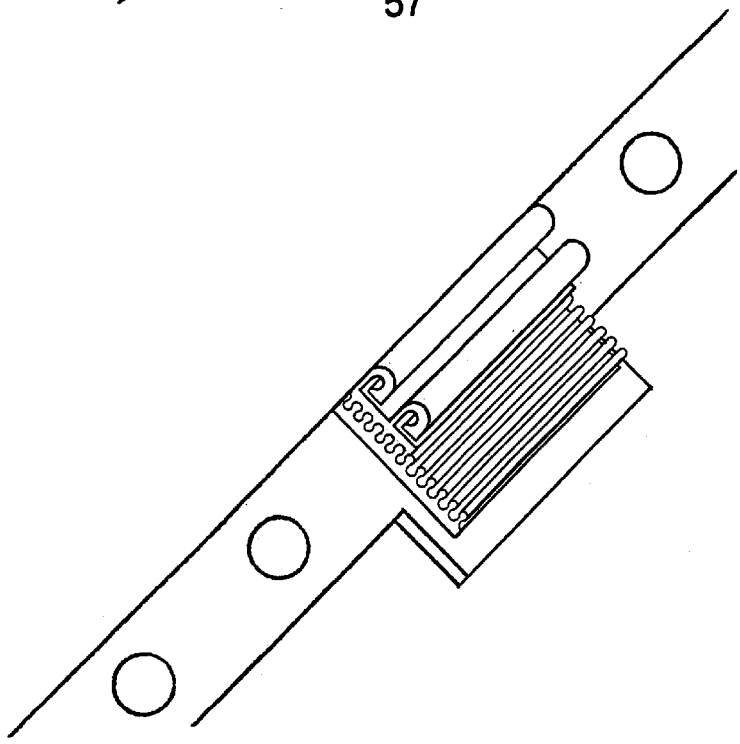

Another version of a bearing assemblage accommodating variable positioning of axle about which rotation of actuating lever takes place is shown in FIG. 7A. This bearing assemblage which is similar to the first version previously described has an undersurface in which a series of recesses 54 and protrusions 55 exist. These recesses and protrusions are detachably engageable in an interfitting fashion with a series of recesses 56 and protrusions 57 location on the bearing mount seen in FIG. 7B and as such the bearing assemblage can be detached from one position along the series of recesses 56 and protrusions 57 located on the bearing mount and reattached at a different position along same series of recesses 56 and protrusions 57 as shown in FIG. 7C.

Even though not shown in any of the figures the catch element could also be repositionable to the catch mount in a manner similar to that of the bearing assemblage described in the previous paragraph.

When the device is fastened or during fastening of device the opposing lateral fastening forces transmitted throughout the device urge the device into an optimium static state of equilibrium. In this state as much of the device acted upon by one lateral fastening force is urged as close as possible to as much of the device acted upon the opposing fastening force. In the present device and in attempting to achieve this optimum static state of equilibrium the lateral fastening forces urge an orientation of the engageable elements 6 and 12, or 6 and 36', or 6 and 38' and the parts of the device to which said engageable elements are fixedly connected where the maximum possible contact occurs between said engageable elements when the static state of equilibrium is reached. This maximum possible contact occurs when the engaged element 6 and 12, or 6 and 36', or 6 and 38' are parallel to each other and to a longitudinal median of shoe to which fastening device is secured as seen in FIGS. 1, 2, and 3B respectively.

In a situation where parts of the device to which said engageable elements are fixedly secured are themselves fixed and where the initial orientation of the engageable elements are such that they are not parallel to each other and to the longitudinal median of shoe, the following ramification of the device is designed to accommodate the above mentioned urging by allowing swiveling of both the catch element and the bearing assemblage with attached lever and tie element are secured so that the engageable elements can become parallel to each other when engaged. The bearing assemblage 42 as seen in FIGS. 4A, 4B, and 4C and bearing assemblage 50 as seen in FIGS. 5A, 5B, and 5C as well as the catch element 6' as seen in FIGS. 6A, 6B, and 6C all rest on swivel bases comprising a swivel disc 58. The swivel disc is confined to and rotatable within the bearing mount 20' in the case of the bearing assemblages 42 and 50 or catch mount 24' in the case of the catch element 6'. The disc is located within a volume of space almost identical in shape and size to itself where this volume of space is large enough to allow disc to just fit and swivel. The swivel disc is connected to bearing assemblage 42, and 50, or to catch element 6', via a concentric axle 60 having one end connected to swivel disc 58 and other end connected to the undersurfaces 42*a* and 50*c* of bearing assemblages 42 and 50 respectively as seen in FIGS. 4A & 4B and 5A & 5B, and to undersurface 6*a* of each mount as seen in FIGS. 6A & 6B. The undersurfaces 42*d* and 50*c* of the hearing assemblages 42 and 50 and 6*a* of the catch elements 6' are parallel to the surfaces of the mounts above which they are located and on which they rest but are not directly connected to these surfaces. FIGS. 4C, 5C, and 6C each show the swiveling motion of 42, 50 and 6' respectively.

What is claimed is:

1. A fastening device for directing together the dual opposing flap portions of a shoe, said device comprising an elongate bearing mount with a bearing assemblage located thereupon defining at least one axis of rotation substantially parallel to said bearing mount; an actuating lever pivotally securable about said axis; a tie element comprising a single substantially flat and rigid component defining an upper surface and undersurface with at least one surface to surface aperture formed therein where said aperture defines two facing surfaces significantly parallel to said axis, and where said tie element is hinged onto said actuating lever whereby extending substantially in alignment therewith; an elongate catch mount with at least one catch element located thereupon to engage one of said two facing surfaces.

2. The device of claim 1 where said tie element contains a series of said surface to surface apertures arranged along a line perpendicular to said axis.

3. The device of claim 1 where said bearing assemblage defines multiple axle supports.

4. The device of claim 1 where said bearing assemblage is secured to said bearing mount via swivel means.

5. The device of claim 1 wherein said bearing assemblage is located on a base, said base being detachable from and securely repositionable on bearing mount along a line perpendicular to said axis.

6. The device of claim 1 whereupon said actuating lever exists at least one fixed structure which can be held in snapped mutual engagement with a complimentary corresponding structure, said complimentary corresponding structures being located on a part of said device that is fixed relative to said actually lever.

7. A fastening device for directing together the duel opposing flap portions of a shoe comprising an elongate bearing mount with a bearing assemblage located thereupon defining at least one axis of rotation substantially parallel to said bearing mount; an actuating lever pivotably securable about said axis; a tie element hinged onto said actuating lever whereby extending substantially in alignment therewith comprising a single rigid component defining a substantially planar undersurface with a plurality of hook elements projecting therefrom each defining an essentially planar elongate surface parallel to said axis of rotation and significantly perpendicular to said undersurface; an elongate catch mount with at least one catch element located thereupon to engage said hook elements.

8. The device of claim 7 where said bearing assemblage defines multiplex axis supports.

9. The device of claim 7 where said bearing assemblage is secured to said bearing mount via swivel means.

10. The device of claim 7 where said hearing assemblage is located on a base, said base being detachable from and securely repositionable on bearing mount along a line perpendicular to said axis.

11. The combination of shoe and device of claim 7 whereupon said actuating lever exists at least one fixed structure which can be held in snapped mutual engagement with a complimentary corresponding structure, said complementary corresponding structure being located on a part of said device that is fixed relative to said actuating lever.

12. A fastening device for directing together the duel opposing flap portions of a shoe comprising an elongate bearing mount with a bearing assemblage located thereupon defining at least one axis of rotation substantially parallel to said bearing mount; an actuating lever pivotally securable about said axis; a tie element comprising a rigid component and defining a substantially planar undersurface and hinged onto said actuating lever whereby extending substantially in alignment therewith; at least one hook element projecting from said undersurface of tie element; an elongate catch mount with at least one catch element located thereupon to engage said hook element.

13. The device of claim 12 where said hook element is a detachable adjunct of said tie element and is refastenable to said tie element at various points along said undersurface of tie element.

14. The device of claim 13 where said hook element defines an upper surface in which recesses and protrusion exist.

15. The device of claim 13 where in undersurface of said tie element exists a series of recesses and protrusions which can achieve snapped mutual engagement with an adjunct hook element which has an upper surface when complimentary interfitting recesses and protrusions exist.

16. The device of claim 12 whereupon said actuating lever exists at least one fixed structures which can be held in snapped mutual engagement with a complimentary corresponding structure, said complimentary corresponding structure being located on a port of said device that is fixed relative to said actuating lever.

17. The device of claim 12 where said bearing assemblage defines multiple axle supports.

18. The device of claim 12 wherein said bearing assemblage is secured to said bearing mount via swivel means.

19. The device of claim 12 where said bearing assemblage is located on a base, said base being detachable from and securely repositionable on bearing mount along a line perpendicular to said axis.

* * * * *